United States Patent [19]

Hiller et al.

[11] 3,930,811

[45] Jan. 6, 1976

[54] REACTOR FOR THE PRESSURE GASIFICATION OF COAL

[75] Inventors: Heinz Hiller, Rembrucken; Paul Rudolph, Bad Homburg, both of Germany

[73] Assignee: Metallgesellschaft Aktiengesellschaft, Frankfurt am Main, Germany

[22] Filed: Sept. 18, 1974

[21] Appl. No.: 507,178

[30] Foreign Application Priority Data

Oct. 17, 1973 Germany ..... 2351963

[52] U.S. Cl. ..... 48/63; 48/68

[51] Int. Cl.[2] ..... C10J 3/16; C10J 3/42

[58] Field of Search ..... 48/63, 73, 77, 99, 202, 48/203, 210, 86 R, 68

[56] References Cited

UNITED STATES PATENTS

| | | | |
|---|---|---|---|
| 1,412,118 | 11/1922 | Johnston | 48/86 R |
| 1,810,738 | 6/1931 | VanHeeden | 48/63 |
| 1,814,787 | 7/1931 | Daae | 48/86 R X |
| 1,972,897 | 9/1934 | Odell | 48/63 X |
| 2,808,321 | 10/1957 | Junkers | 48/68 X |

*Primary Examiner*—R. E. Serwin
*Attorney, Agent, or Firm*—Burgess, Dinklage & Sprung

[57] ABSTRACT

A reactor for the continuous gasification of coal under superatmospheric pressures and elevated temperatures with gaseous gasifying agents containing free oxygen and with oxygen-free gasifying agents such as steam and/or carbon dioxide is disclosed. The reactor includes a substantially conical rotary grate which is rotatably mounted in the lower portion of the reactor housing. The rotary grate feeds the gasifying agent and/or discharges the gasification residues. Notwithstanding the inside diameter of the reactor housing, the clearance *a* between the rotary grate and the housing is 100–200 millimeters, the height *b* of the annular rim of the rotary grate is 100–350 millimeters, and the vertical distance *c* from the rotary grate to the housing bottom is 100–350 millimeters.

4 Claims, 1 Drawing Figure

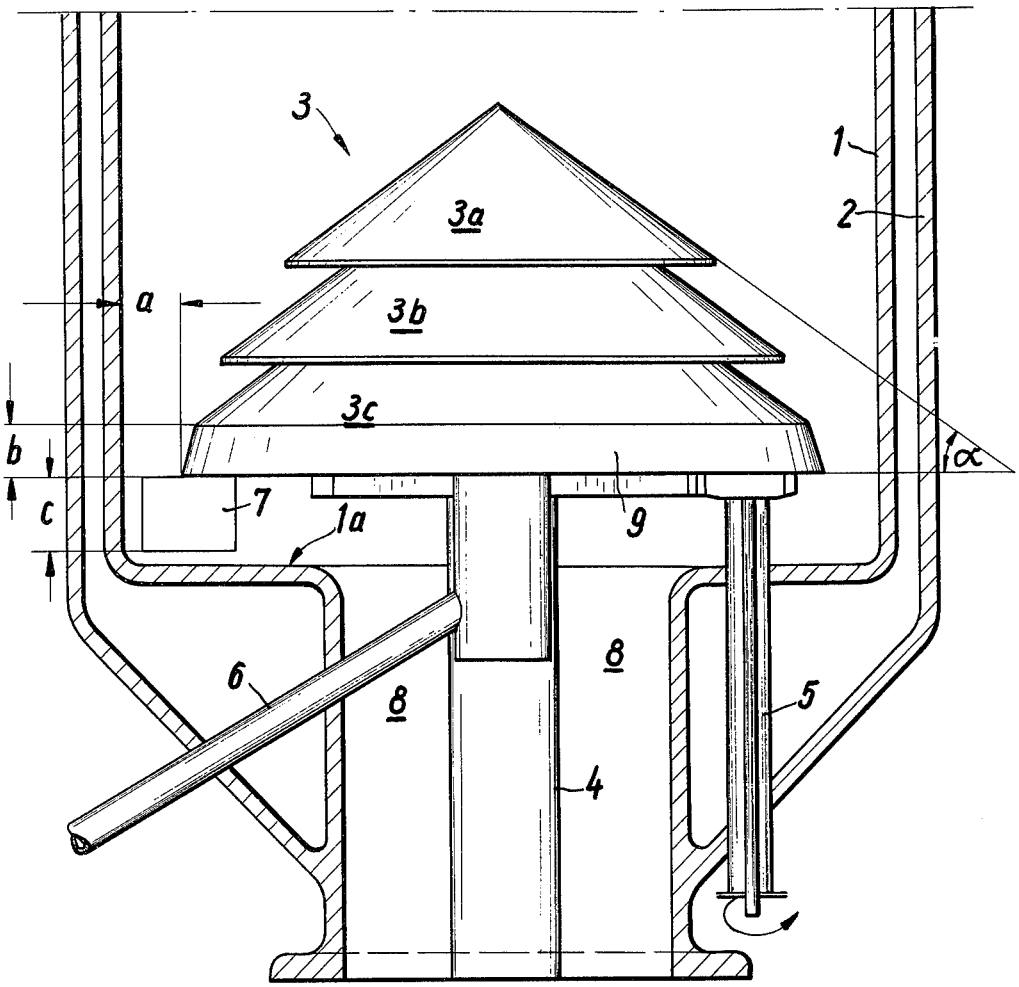
3
1
2
3a
3b
3c
a
b
c
α
7
1a
9
6
8
8
5
4

REACTOR FOR THE PRESSURE GASIFICATION OF COAL

BACKGROUND OF THE INVENTION

This invention relates to a reactor for a continuous gasification of coal under superatmospheric pressure and at elevated temperatures with gaseous gasifying agents which contain free oxygen and with oxygen-free gasifying agents such as water vapor and/or carbon dioxide, comprising a substantially conical grate which is rotatably mounted in the lower portion of the reactor housing (rotary grate) and serves for feeding the gasifying agent and/or discharging the gasification residues.

It has been found that difficulties arise in such gas producers under certain operating conditions in connection with the discharge of the ash from the gas-producing space. Particularly under partial-load conditions, an irregular behavior occurs, which may have the result, e.g., that a reduction of the speed of the grate in proportion with the load is by no means accompanied by a corresponding reduction of the ash discharge rate, which may be either too high or too low, depending on the design of the grate. Additional influences, such as the height of the ash bed, the state of the ash, and the composition of the gasifying agents are significant. This may necessitate intermittent additional steps for removing the ash from the grate plane of the gas producer. In case of difficulties of that kind, a great attention and high qualification are required on the part of the operators so that they can recognize the position and state of the ash bed in the gas producer.

Disturbances in operation arise also, e.g., in case of change of the composition of the ash and a resulting change of its melting and sintering behavior. In known gas producers this also influences the ash discharge rate so that the gas production rate and the composition of the product gas are affected too. If additional means are provided to avoid a retention of ash and this results in a withdrawal of ash at an excessive rate, the core portion of the coal bed may descend too close to the grate. As this core of the coal bed is at the highest temperatures (above 800°C.), a local overheating and destruction of the grate may result. The difficulties involved in the correct adjustment of the grate sometimes cause also an unequal distribution of the gasifying agents emerging from the grate so that existing irregularities, such as an inclination of the ash bed, may be intensified although this is not desired. Such phemomena may result in a unintended decrease of the output of the gas producer for hours and in a steep rise of the content of unburnt coal in the ash. On the other hand, the carbon dioxide content in the product gas increases compared to its combustible constituents.

Changes in design which have been adopted in the past have not basically improved the situation because they have changed also the flow behavior of the ash. When the cross-section of flow of the ash was decreased, larger lumps of ash or an accumulation of sintered ash particles resulted in a clogging whereas in case of an increased flow area in conjunction with a high gas production rate a large amount of the material to be gasified suddenly flowed down into the ash lock without apparent cause and in spite of a constant speed of the grate.

SUMMARY

It has surprisingly been found that the difficulties arising with known gas producers can be avoided and a perfectly stable gas producer operation may be adjusted even under changed load conditions and fluctuating ash contents and ash properties if the measures according to the invention are adopted. These reside in that, regardless of the inside diameter of the reactor housing, the clearance *a* between the rotary grate and the housing is 100–200 millimeters, the height *b* of the annular rim of the rotary grate is 100–350 millimeters and the vertical distance *c* from the rotary grate to the housing bottom is 100–350 millimeters.

A further optimization will be achieved if the conical surface of the rotary grate has an angle of elevation between 35° and 50°. It has been surprisingly found that the latter range and the above-mentioned ranges are applicable virtually independently of the diameter of the gas producer and are not influenced, e.g., by the locations of the inlets for the gasifying agents.

DESCRIPTION

A gas producer designed in accordance with the specification taught by the invention can be satisfactory operated under partial-load conditions down to a load of 10–20% of the rated load and with grate speeds which have a fixed and reproducible ratio to the throughput rate of the reactor. Changes in the composition of the ash no longer result in an obstruction nor in an excessively fast downflow of the ash. This result is apparently due to a more uniform distribution of the coal-ash bed as it descends inside the gas producer and in a more uniform flow through the outlet cross-section as a result of the measures taught by the invention.

An illustrative embodiment of the reactor will now be explained more fully with reference to the drawing which shows the lower portion of the reactor in vertical sectional view whereas the rotary grate contained in the reactor is shown in elevation.

The reactor housing consists of an inner wall 1 and an outer wall 2 which together define a cooling water jacket. The rotary grate 3 has approximately the shape of a cone, and its outside surface is composed of parts 3*a*, 3*b*, and 3*c*, which extend one into the other. The upper part 3*a* partly covers the intermediate part 3*b* and the latter partly covers the lower part 3*c* so that the material to be gasified resting on the grate 3 cannot enter the interior thereof.

The rotary grate is mounted on a supporting cylinder 4 and by means (not shown) is rotated about its vertical axis by a shaft 5. Gasifying agents are conducted from the outside in at least one conduit 6 first into the interior of the grate and are then distributed into the reactor through the spaces between the parts 3*a* and 3*b* and 3*b* and 3*c*.

At least one scraper 7 which is similar to a plowshare is provided on the lower part 3*c* of the grate and during a rotation of the grate feeds the ash to a discharge lock 8, from which the ash is withdrawn through a pressure lock (not shown). The ash collects on the housing bottom 1*a* to a certain height, and ungasified coal is disposed above said ash outside of the grate in upwardly increasing amounts. The umbrella shape of the conical grate promotes the downflow of the ash toward the scraper 7. For the same purpose, the lower part 3*c* has an annular rim 9, which slopes down toward the lower edge of the grate at a small angle to the vertical.

It has been found that for an operation without disturbances of the kind explained hereinbefore, certain dimensions must be adopted which are related to the rotary grate and to its relation to the reactor housing. The clearance *a* between the rotary grate and the inside wall 1 must be 100–200 millimeters, the height *b* of the rim 9 of the grate must be 100–350 millimeters, and the vertical distance *c* from the lower edge of the lower part 3*c* and the housing bottom 1*a* must be 100–350 millimeters. In a preferred embodiment of the gas producer, the clearance *a* is about 150–200 millimeters and the distance *c* between 150 and 250 millimeters.

The optimum mode of operation of the reactor is also influenced by the angle of elevation $\alpha$ of the upper part 3*a* of the grate. With slight deviations, this equals the mean angle of elevation of the conical surface of the entire grate. This angle of elevation $\alpha$ is desirably about 35°–50° and in the abovementioned embodiment is about 45°. Small deviations of the design of the grate from the form shown are possible within the scope of the invention. For instance, e.g., the top of the upper part 3*a* may be somewhat rounded.

EXAMPLE 1 (The Invention)

Long-flaming gas coal containing 20% ash and 8% moisture were gasified in a reactor according to the invention having the dimensions $a = 170$ millimeters, $b = 200$ millimeters, $c = 200$ millimeters and $\alpha = 45°$. Oxygen at a rate of 1500 standard cubic meters per hour and water vapor at a rate of 11,730 kilograms per hour were used as gasifying agents. At a rate of 10,640 standard cubic meters per hour, a raw gas was produced which at the outlet of the gas producer had the following composition in % by volume on a dry basis:

| | |
|---|---|
| $CO_2$ | 30.8 |
| $C_nH_m$ other than $CH_4$ | 0.4 |
| $O_2$ | 0.1 |
| CO | 15.9 |
| $H_2$ | 41.7 |
| $CH_4$ | 10.6 |
| $N_2$ | 0.5 |

The coal throughout amounted to 6,300 kilograms per hour. The ash contained 60 kilograms carbon per hour and tar was produced at a rate of 550 kilograms per hour. No difficulties at all were involved in the discharge of ash, not even during a change of the load range.

EXAMPLE 2 (Prior Art)

The coal described in Example 1 was gasified in a gas producer which is known in the art and had the dimensions $a = 250$ millimeters, $b = 80$ millimeters, $c = 500$ millimeters, and $\alpha = 30°$. Oxygen at a rate of 1500 standard cubic meters per hour and steam at a rate of 12,000 kilograms per hour were added as gasifying agents. At a rate of 9,410 standard cubic meters per hour, a raw gas was produced which had the following composition in % by volume on a dry basis:

| | |
|---|---|
| $CO_2$ | 33.6 |
| $C_nH_m$ other than $CH_4$ | 0.4 |
| $O_2$ | 0.1 |
| CO | 15.1 |
| $H_2$ | 41.9 |
| $CH_4$ | 8.3 |
| $N_2$ | 0.6 |

The coal throughput amounted to 5,700 kilograms per hour. The ash contained 90 kilograms carbon per hour, and tar was produced at a rate of 470 kilograms per hour.

Compared to Example 1, the data obtained in Example 2 are inferior as regards the coal throughput and the gas production rate. Example 1 had the advantage of resulting in a lower $CO_2$ content and a higher methane content, which meant a higher calorific value of the product gas. The more intense gasification and the resulting improved utilization of the feed coal in Example 1 were also apparent from the lower carbon content of the ash. It was also found in Example 2 that under partial-load conditions the ash discharge rate was not proportional to the load and a frequent readjustment and change of the grate speed was required to enable a continued control of the operation of the gas producer.

What is claimed is:

1. Reactor for the continuous gasification of coal under superatmospheric pressures at elevated temperatures with gaseous gasification agents which contain free oxygen and with oxygen-free gasifying agents such as water vapor and/or carbon dioxide, comprising substantially conical rotary grate means rotatably mounted in the lower portion of the stationary reactor housing, said reactor housing having a central ash discharge conduit below the rotary grate means, said rotary grate means being adapted to feed gasifying agent and/or discharge gasification residues, notwithstanding the inside diameter of the reactor housing, the clearance *a* between the rotary grate means and the housing is 100–200 millimeters, the height *b* of the annular rim of the rotary grate means is 100–350 millimeters, and the vertical distance *c* from the rotary grate means to the housing bottom is 100–350 millimeters, said rotary grate means having at least one scraper affixed thereto to withdraw ash from the housing bottom and move it to said central ash discharge conduit.

2. Reactor of claim 1 wherein the clearance *a* amounts to at least 150 millimeters and the clearance *c* to 150–250 millimeters.

3. Reactor of claim 1 wherein the angle of elevation $\alpha$ of the conical surface of the rotary grate is 35°–50°.

4. Reactor of claim 3 wherein the angle of elevation $\alpha$ is about 45°.

* * * * *